US010662512B2

(12) United States Patent
Ishikawa

(10) Patent No.: US 10,662,512 B2
(45) Date of Patent: May 26, 2020

(54) ABRASION-RESISTANT STEEL

(71) Applicant: NIPPON STEEL & SUMITOMO METAL CORPORATION, Tokyo (JP)

(72) Inventor: Kyohei Ishikawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/080,742

(22) PCT Filed: Sep. 14, 2017

(86) PCT No.: PCT/JP2017/033302
§ 371 (c)(1),
(2) Date: Aug. 29, 2018

(87) PCT Pub. No.: WO2018/052089
PCT Pub. Date: Mar. 22, 2018

(65) Prior Publication Data

US 2019/0062882 A1 Feb. 28, 2019

(30) Foreign Application Priority Data

Sep. 15, 2016 (JP) ..... 2016-180889

(51) Int. Cl.
*C22C 38/00* (2006.01)
*C22C 38/12* (2006.01)
(Continued)

(52) U.S. Cl.
CPC ..... *C22C 38/12* (2013.01); *C21D 1/18* (2013.01); *C21D 6/001* (2013.01); *C21D 6/002* (2013.01);
(Continued)

(58) Field of Classification Search
CPC ..... C22C 38/00; C22C 38/06; C22C 38/12
(Continued)

(56) References Cited

U.S. PATENT DOCUMENTS

2014/0096875 A1 4/2014 Ueda et al.
2016/0010191 A1 1/2016 Li et al.
(Continued)

FOREIGN PATENT DOCUMENTS

CN 103147017 A 6/2013
CN 103205634 A 7/2013
(Continued)

OTHER PUBLICATIONS

NPL English translation of JP 2007231320 A, Sep. 2007 (Year: 2007).*
(Continued)

*Primary Examiner* — Jie Yang
(74) *Attorney, Agent, or Firm* — Birch, Stewart, Kolasch & Birch, LLP

(57) ABSTRACT

Provided is an abrasion-resistant steel including a predetermined chemical composition, in which content (mass %) of Mo and B satisfy Mo×B>0.0010, a mass fraction of $Mo_2FeB_2$ is from 0.0010 to 0.10%, an area ratio of martensite in a central portion in a thickness direction is 70% or more, Ceq obtained by the following (Formula 1) is 0.80% or less, and a plate thickness exceeds 50 mm;

$$Ceq=C+Mn/6+(Cu+Ni)/15+(Cr+Mo+V)/5 \quad \text{(Formula 1)}$$

wherein, in (Formula 1), C, Mn, Cu, Ni, Cr, Mo, and V are contents (mass %) of each element.

5 Claims, 2 Drawing Sheets

(51) Int. Cl.

| | |
|---|---|
| ***C22C 38/54*** | (2006.01) |
| ***C22C 38/08*** | (2006.01) |
| ***C22C 38/28*** | (2006.01) |
| ***C21D 6/00*** | (2006.01) |
| ***C22C 38/16*** | (2006.01) |
| ***C21D 1/18*** | (2006.01) |
| ***C21D 9/46*** | (2006.01) |
| ***C22C 38/32*** | (2006.01) |
| ***C21D 6/02*** | (2006.01) |
| ***C22C 38/22*** | (2006.01) |
| ***C22C 38/14*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 6/004* (2013.01); *C21D 6/005* (2013.01); *C21D 6/008* (2013.01); *C21D 6/02* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/14* (2013.01); *C22C 38/16* (2013.01); *C22C 38/22* (2013.01); *C22C 38/28* (2013.01); *C22C 38/32* (2013.01); *C22C 38/42* (2013.01); *C22C 38/46* (2013.01); *C22C 38/48* (2013.01); *C22C 38/50* (2013.01); *C22C 38/54* (2013.01)

(58) Field of Classification Search
USPC ..... 420/121
See application file for complete search history.

(56) References Cited

U.S. PATENT DOCUMENTS

| | | | |
|---|---|---|---|
| 2016/0060721 | A1 | 3/2016 | Nagao et al. |
| 2016/0076118 | A1 | 3/2016 | Nagao et al. |
| 2018/0044766 | A1* | 2/2018 | Tidesten ..... C22C 19/03 |

FOREIGN PATENT DOCUMENTS

| | | | |
|---|---|---|---|
| JP | 6-116635 | A | 4/1994 |
| JP | 7-197125 | A | 8/1995 |
| JP | 9-118950 | A | 5/1997 |
| JP | 2003-205352 | A | 7/2003 |
| JP | 2007-231320 | A | 9/2007 |
| JP | 2009-30092 | A | 2/2009 |
| JP | 2011-174154 | A | 9/2011 |
| JP | 2012-26030 | A | 2/2012 |
| JP | 2012-214890 | A | 11/2012 |
| JP | 2014-100730 | A | 6/2014 |
| JP | 2014-194042 | A | 10/2014 |
| JP | 2014-194043 | A | 10/2014 |
| JP | 2016-505094 | A | 2/2016 |
| JP | 2016-79459 | A | 5/2016 |
| WO | WO 2016/099390 | A1 | 6/2016 |

OTHER PUBLICATIONS

International Search Report, issued in PCT/JP2017/033302, dated Oct. 24, 2017.
Written Opinion of the International Searching Authority, issued in PCT/JP2017/033302, dated Oct. 24, 2017.
Office Action dated Jan. 3, 2019, in Chinese Patent Application No. 201780012940.4, with English translation.
Extended European Search Report dated May 28, 2019, in European Patent Application No. 17850989.9.
Chinese Office Action for Chinese Application No. 201780012940.4, dated Jul. 13, 2019, with an English translation.
Chinese Office Action dated Sep. 23, 2019, for corresponding Chinese Patent Application No. 201780012940.4, with partial English translation.
Ishikawa et al., "Effect of Molybdenum Content on the Combined Effect of Boron and Molybdenum on Hardenability of Low-Carbon Boron-Added Steels", ISIJ International, vol. 58, No. 3, 2018, pp. 551-560.

* cited by examiner

[Fig. 3]
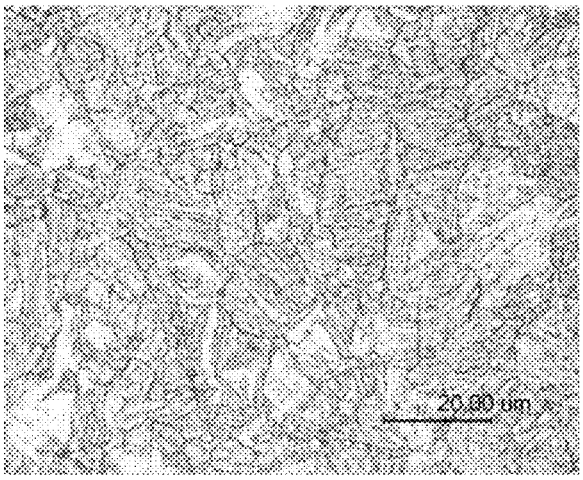

ABRASION-RESISTANT STEEL

TECHNICAL FIELD

The present disclosure relates to an abrasion-resistant steel.

BACKGROUND ART

In general, the abrasion resistance of steels is correlated with the hardness. For example, for abrasion-resistant steels used in industrial machines such as cutting edges of industrial waste processing machines, a high hardness of from 360 to 550 in Brinell hardness HB on the surface is required. In order to increase the hardness of a steel, it is effective to make the metal structure into martensite by quenching, and conventionally, an abrasion-resistant steel improved in hardenability by containing a variety of alloy elements has been proposed (see, for example, Patent Documents 1 to 4).

In recent years, with the increase in the size of industrial machine and the like, thick abrasion-resistant steels are being required. For example, abrasion-resistant steel plates having a plate thickness of about from 50 to 100 mm are manufactured. From the viewpoint of prolonging the life with respect to abrasion, abrasion-resistant steels having small differences in hardness between surface layers and central portions in the plate thickness are being required. To satisfy such requirements, abrasion-resistant steels containing Nb and B, and further one kind or more of Cu, Ni, Cr, Mo, V, and Ti have been proposed (for example, see Patent Document 5).

Patent Document 1: Japanese Patent Application Laid-Open (JP-A) No. 2016-79459
Patent Document 2: JP-A No. 2014-194043
Patent Document 3: JP-A No. 2014-194042
Patent Document 4: JP-A No. 2012-214890
Patent Document 5: JP-A No. H09-118950

SUMMARY OF INVENTION

Problems to be Solved by the Invention

Conventionally, for example, when manufacturing a thick abrasion-resistant steel, the cooling rate at a central portion in the plate thickness becomes slow. Therefore, it is necessary to contain a large content of expensive alloy elements such as Mo, Cr, Cu, and Ni to secure hardenability, resulting in high cost. In such cases, B which remarkably improves the hardenability of a steel in a trace content is utilized as an extremely useful element for avoiding an increase in alloy cost.

Further, it is known that when B is added together with Mo, the hardenability is remarkably improved. However, an effect corresponding to the contents of B and Mo may not be obtained in some cases.

One aspect of the present disclosure is to provide an abrasion-resistant steel in which the hardenability of B is effectively utilized, the plate thickness exceeds 50 mm, and the hardness difference between a central portion in the plate thickness and the surface is small.

Means for Solving the Problems

Means for solving the problem includes the following aspects.

<1> An abrasion-resistant steel, including, by mass %:
C: 0.10 to 0.40%,
Si: 0.05 to 0.50%, Mn: 0.50 to 1.50%,
B: 0.0015 to 0.0050%,
Mo: 0.60 to 2.50%,
Al: 0 to 0.300%,
S: 0.010% or less,
P: 0.015% or less,
N: 0.0080% or less,
Ti: 0 to 0.100%,
Nb: 0 to 0.100%,
Cu: 0 to 1.50%,
Ni: 0 to 2.00%,
Cr: 0 to 2.00%,
V: 0 to 0.20%,
Ca: 0 to 0.0100%,
REM: 0 to 0.0100%,
Mg: 0 to 0.0100%,
W: 0 to 2.00%, and
a balance: Fe and impurities, wherein:
contents (mass %) of Mo and B satisfy $Mo \times B > 0.0010$,
a mass fraction of $Mo_2FeB_2$ is from 0.0010 to 0.1000%,
an area ratio of martensite in a central portion in a thickness direction is 70% or more,
Ceq obtained by the following (Formula 1) is 0.80% or less, and
a plate thickness exceeds 50 mm;

$$Ceq = C + Mn/6 + (Cu+Ni)/15 + (Cr+Mo+V)/5 \quad \text{(Formula 1)},$$

wherein, in (Formula 1), C, Mn, Cu, Ni, Cr, Mo, and V are contents (mass %) of each element.

<2> The abrasion-resistant steel according to <1>, wherein a mass fraction of $Fe_{23}(C, B)_6$ is 0.0020% or less.

<3> The abrasion-resistant steel according to <1> or <2>, wherein the contents (mass %) of Mo and B satisfy $Mo \times B \geq 0.0015$.

<4> The abrasion-resistant steel according to <1> or <2>, wherein the contents (mass %) of Mo and B satisfy $Mo \times B \geq 0.0020$.

<5> The abrasion-resistant steel according to any one of <1> to <4>, wherein a content (mass %) of Mo satisfies from 0.70 to 2.50%.

Effects of the Invention

According to the disclosure, it is possible to provide an abrasion-resistant steel in which the hardenability of B is effectively utilized, the plate thickness exceeds 50 mm, and the hardness difference between a central portion in the plate thickness and the surface is small. Accordingly, industrial contribution of the disclosure is extremely remarkable.

BRIEF DESCRIPTION OF DRAWINGS

FIG. 3 is a view showing an observation photograph of a central portion in the thickness direction of an abrasion-resistant steel by an optical microscope.

DESCRIPTION OF EMBODIMENTS

The abrasion-resistant steel which is an example of the disclosure below will be described in detail.

In the disclosure, the percentage of the content of each element means % by mass unless otherwise specified.

In the disclosure, a numerical range expressed using "from A to B" means a range including numerical values A and B as a lower limit value and an upper limit value.

The abrasion-resistant steel of the disclosure has a predetermined chemical composition, the contents (mass %) of Mo and B satisfy Mo×B>0.0010, the mass fraction of $Mo_2FeB_2$ is from 0.0010 to 0.1000%, the area ratio of martensite in a central portion in the thickness direction is 70% or more, Ceq obtained by the following (Formula 1) is 0.80% or less, and the plate thickness exceeds 50 mm.

According to the above configuration of the abrasion-resistant steel of the disclosure, the hardenability of B is effectively utilized, and when the plate thickness exceeds 50 mm, the difference in hardness between a central portion in the plate thickness and the surface becomes small. The abrasion-resistant steel of the disclosure was discovered by the following findings.

The inventors have focused on the relationship between the contents of Mo and B and the hardenability and studied abrasion-resistant steels with small change in hardness depending on the cooling rate and a method of manufacturing the same. As a result, the inventors obtained a finding that the hardenability is stably improved by increasing the contents of B and Mo, by heating to an appropriate temperature and quenching, as compared with conventional art. As a result of investigating the cause, it was found that a precipitation $Mo_2FeB_2$ which has not been observed in low alloy steels is generated, thereby suppressing reduction in hardenability. Specifically, it is as follows.

Figure 1:
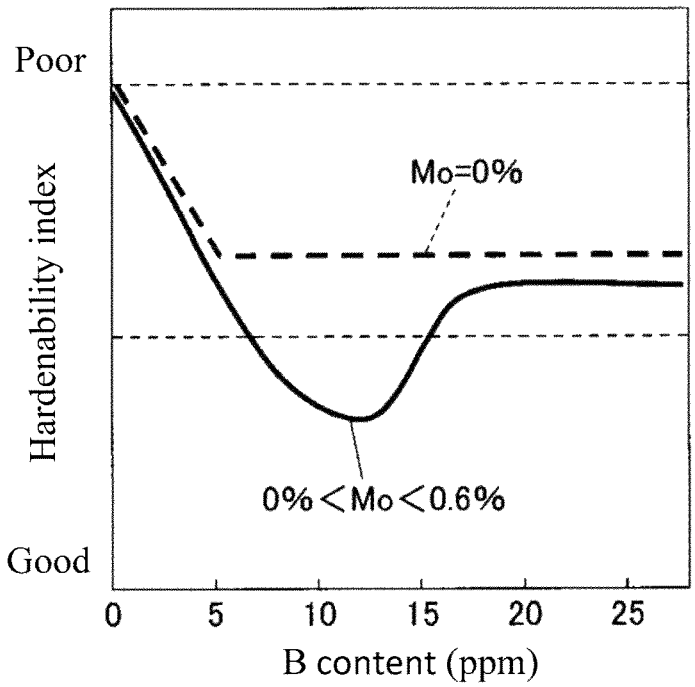
FIG. 1 is a view for explaining the hardenability of a conventional steel containing Mo and B.

In general, B is an element that improves hardenability even in a trace content, and an effect is exhibited when the content is 0.0003% or more. Conventionally, Mo is known as an element for improving hardenability by containing Mo together with B at the same time. However, as shown in FIG. 1, in the case of a steel containing less than 0.60% of Mo, it is understood that when the content of B exceeds 15 ppm (0.0015 mass %), the hardenability deteriorates greatly. The reason why the hardenability deteriorates is due to precipitation of $Fe_{23}(C,B)_6$, and there was a problem that a stable hardenability is unable to be obtained unless the content of B is strictly controlled.

Figure 2:
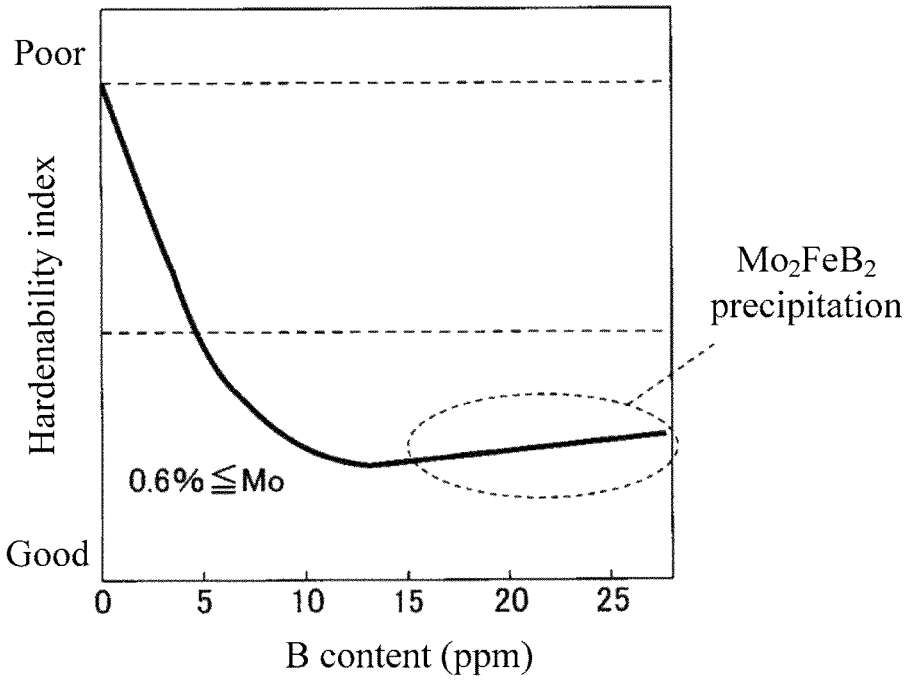
FIG. 2 is a view for explaining hardenability of a steel containing Mo and B.

In order to more effectively utilize an effect of improving the hardenability due to inclusion of B, the inventors examined the relationship between the contents of Mo and B and the hardenability. As a result, as shown in FIG. 2, it was found that when 0.60% or more of Mo is contained, even when B is contained at 15 ppm or more, it is possible to stably obtain high hardenability. When a precipitate was analyzed by a transmission electron microscope, it was found that $Mo_2FeB_2$ was precipitated.

As shown in FIG. 1, an effect of B is highest when the content is about 0.0010%, and the effect tends to deteriorate when the content is larger than or less than that. Therefore, conventionally, B was contained in a content of about 0.0010% in order to make the most of the effect of B, and in such a case, as the thickness increases, the cooling rate decreases in a central portion in the thickness, causing the hardness to decrease in the thickness direction from the surface layer.

In order to fully utilize the hardenability of B, it is necessary to precipitate $Mo_2FeB_2$. The inventors have further studied and found that the contents of B and Mo need be 0.0015% or more and 0.60% or more, respectively, as described above.

In addition to this, investigations were conducted from the thermodynamic point of view on the condition that $Mo_2FeB_2$ is stably produced (mass fraction: produced at from 0.0010 to 0.1000%). As a result, the inventors have found that the product of Mo content [Mo] (%) and B content [B] (%) is important and that the dependency of cooling rate on hardenability decreases when [Mo]×[B] >0.0010. Further, it was found that the change in the hardness in the thickness direction is further suppressed as compared with the case where the contents of B and Mo are 0.0015% or more and 0.60% or more, respectively.

As described above, in the abrasion-resistant steel of the disclosure, an effect of improving the hardenability of B can be effectively utilized. As a result, it was found that when the plate thickness exceeds 50 mm, the hardness difference between a central portion in the plate thickness and the surface becomes small.

As described above, conventionally, in a region where the Mo content is small (the content of Mo is less than 0.60%), the hardenability improvement effect by B is very likely to change due to a variation of B content (see FIG. 1). Therefore, in order to enjoy a hardenability improving effect by B, the content of B needs to be controlled within a narrow range, resulting in a problem of high production load.

However, according to the abrasion-resistant steel of the disclosure, as shown in FIG. 2, by increasing the contents of B and Mo, from 0.0010 to 0.10% of $Mo_2FeB_2$ is precipitated. As a result, it is possible to enjoy a hardenability improving effect by B in a wide range of B content.

As described above, in the abrasion-resistant steel of the disclosure, the control range of the B content can be relaxed and the manufacturing load can be reduced.

Hereinafter, the reasons for limiting the chemical composition of the abrasion-resistant steel of the disclosure (hereinafter, also referred to as "chemical composition of the disclosure") will be described.

The chemical composition of the disclosure contains C: 0.10 to 0.40%, Si: 0.05 to 0.50%, Mn: 0.50 to 1.50%, B: 0.0015 to 0.0050%, Mo: 0.60 to 2.50%, Al: 0 to 0.300%, S: 0.010% or less, P: 0.015% or less, N: 0.0080% or less, Ti: 0 to 0.100%, Nb: 0 to 0.100%, Cu: 0 to 1.50%, Ni: 0 to 2.00%, Cr: 0 to 2.00%, V: 0 to 0.20%, Ca: 0 to 0.0100%, REM: 0 to 0.0100%, Mg: 0 to 0.0100%, W: 0 to 2.00%, and the balance: Fe and impurities.

It is noted that Al, Ti, Nb, Cu, Ni, Cr, V, Ca, REM, Mg, and W are optional elements. In other words, these elements may be not contained in the abrasion-resistant steel of the disclosure, and the lower limit of the content of these elements is 0%.

[C: 0.10 to 0.40%]

C is the most effective element to promote formation of martensite and increase the hardness. In order to secure the hardness which is the controlling factor of the abrasion resistance, the content of C is set to 0.10% or more. The content of C is preferably 0.13% or more, and more preferably 0.15% or more. On the other hand, C is an element which inhibits workability and weldability when contained in a large content. Therefore, the content of C is set to 0.40% or less. The content of C is preferably 0.35% or less, and more preferably 0.30% or less.

[Si: 0.05 to 0.50%]

Si is a deoxidizing element. In order to obtain an effect of deoxidation, the content of Si is set to 0.05% or more. Si contributes to increasing the hardness by solid solution strengthening. Therefore, the content of Si is preferably set to 0.10% or more. On the other hand, when the content of Si exceeds 0.50%, the toughness remarkably decreases. Therefore, the content of Si is set to 0.50% or less. The content of Si is preferably 0.40% or less, and more preferably 0.30% or less.

[Mn: 0.50 to 1.50%]

Mn is an element contributing to the improvement of hardenability. In order to promote formation of martensite and ensure the hardness, the content of Mn is set to 0.50% or more. The content of Mn is preferably 0.80% or more, and more preferably 1.00% or more. On the other hand, excess Mn deteriorates the toughness. In particular, in the case of a thick material whose plate thickness is enlarged, the influence becomes remarkable. Therefore, the content of Mn is set to 1.50% or less. The content of Mn is preferably 1.40% or less, and more preferably 1.30% or less.

[B: 0.0015 to 0.0050%]

B is the most important element that stably increases the hardenability of the abrasion-resistant steel of the disclosure (reduces the dependency of the cooling rate). In order to fully utilize an effect of improving the hardenability due to the inclusion of B by the formation of $Mo_2FeB_2$, it is needed to make the content of B 0.0015% or more. The content of B is preferably 0.0017% or more, and more preferably 0.0020% or more. On the other hand, excess B coarsens a precipitate, which may impair the toughness. Therefore, the content of B should be 0.0050% or less. The content of B is preferably 0.0045% or less or 0.0044% or less, and more preferably 0.0033% or less or 0.0026% or less.

[Mo: 0.60 to 2.50%]

Mo is an extremely important element for promoting the formation of $Mo_2FeB_2$ which contributes to improvement of hardenability by B. Mo is contained 0.60% or more in order to stably utilize an effect of B. When the content of Mo is less than 0.60%, $Mo_2FeB_2$ is not stably produced even when 0.0015% or more of B is contained. The content of Mo is preferably 0.70% or more or 0.80% or more, and more preferably 0.90% or more or 1.00% or more.

On the other hand, even when Mo is contained in a content exceeding 2.50%, toughness is deteriorated due to coarsening of B precipitate ($Mo_2FeB_2$). Therefore, the Mo content is set to 2.50% or less. However, Mo is an expensive element. Therefore, the content of Mo is preferably 2.00% or less, and more preferably 1.50% or less.

Here, Mo is also an element that retards formation of precipitates ($Fe_{23}(C,B)_6$) that impair an effect of improving the hardenability by B. Therefore, when the content of Mo is within the above range, precipitation of $Fe_{23}(C,B)_6$, which causes decrease in the hardenability, is easily suppressed.

[Mo×B>0.0010]

In order to fully utilize the hardenability of B, it is needed to precipitate a certain content of $Mo_2FeB_2$. Therefore, as described above, the contents of B and Mo need be 0.0015% or more and 0.6% or more, respectively.

In addition to this, the product of the Mo content (Mo) (%) and the B content [B] (%) is important to ensure that $Mo_2FeB_2$ is stably produced (for example, produced with a mass fraction of from 0.0010 to 0.100%). Therefore, [Mo]×[B] is set greater than 0.0010. More preferably, [Mo]×[B] is 0.0012 or more, more preferably 0.0015 or more, particularly preferably 0.0018 or more, and most preferably 0.0020 or more.

It is preferable that [Mo]×[B] is as large as possible. Therefore, it is set to 0.0125 or less which is obtained from the upper limit of the contents of Mo and B. If necessary, the upper limit of [Mo]×[B] may be 0.0100, 0.0070, or 0.0040.

Here, when Mo×B>0.0010, in addition to stable formation of $Mo_2FeB_2$, precipitation of $Fe_{23}(C,B)_6$ which impairs an effect of improving the hardenability by B is also easily suppressed (for example, suppressed to a mass fraction of 0.0020% or less).

Next, the content of Al, impurities S, P, and N used for deoxidation will be described.

[Al: 0 to 0.300%]

Al is a deoxidizing element, and when the content thereof exceeds 0.300%, coarse inclusions are formed to lower toughness. Therefore, the content of Al is set to 0.300% or less. The content of Al is preferably 0.100% or less, and more preferably 0.070% or less. On the other hand, deoxidation is also possible with elements other than Al, and the lower limit may be 0%.

However, Al forms AlN, and is effective for suppressing formation of BN which inhibits the hardenability. The finely precipitated AlN contributes to improvement of toughness by refinement of crystal grain. In order to obtain such an effect, the content of Al may be set to 0.010% or more or 0.030% or more.

[S: 0.010% or Less]

S is susceptible to grain boundary segregation and causes grain boundary cracking. Therefore, the content of S is set to 0.010% or less. S is an element for forming MnS and suppresses deterioration of toughness due to formation of coarse MnS. Therefore, the content of S is preferably 0.005% or less. The content of S is more preferably 0.003% or less. The content of S is desirably reduced as much as possible, and S may be permitted to be contained 0.0001% or more in consideration of cost.

[P: 0.015% or Less]

P is a harmful element causing grain boundary cracking and weld cracking.

Therefore, the content of P is set to 0.015% or less. The content of P is preferably 0.012% or less. The content of P is desirably reduced as much as possible, and may be permitted to be contained 0.001% or more in consideration of cost.

[N: 0.0080% or Less]

N is an element that forms a nitride, and when BN is generated, the hardenability deteriorates. In order to suppress precipitation of BN, Al or Ti may be contained. Further, when the content of N exceeds 0.008%, coarse nitrides are formed, which causes deterioration in toughness. Therefore, the content of N is set to 0.0080% or less. The content of N is preferably 0.0070% or less, and more preferably 0.0060% or less. It is desirable that the content of N be reduced as much as possible, and N may be permitted to be contained in a content of 0.0010% or more in consideration of cost.

Here, the abrasion-resistant steel of the disclosure may contain one kind, or two or more kinds of Ti, Nb, Cu, Ni, Cr, V, and W in order to improve abrasion resistance due to formation of a precipitate or improvement of the hardenability. The inclusion of these elements is not indispensable. In other words, the lower limit of these contents is 0%.

[Ti: 0 to 0.100%]

Like Al, Ti is an element used for deoxidation and nitride formation. However, when the content of Ti exceeds 0.100%, coarse TiN is formed and the toughness deteriorates. Therefore, when Ti is contained, the content of Ti is set to 0.100% or less. The content of Ti is preferably 0.050% or less, and more preferably 0.030% or less. In order to suppress formation of BN and obtain an effect of improving the hardenability by B, the content of Ti is preferably 0.0030% or more. The content of Ti is more preferably 0.0050% or more, and still more preferably 0.0100% or more. In order to suppress formation of BN by formation of TiN, it is preferable to set Ti/N to 3.4 or more.

[Nb: 0 to 0.100%]

Nb is an element which forms carbides and nitrides and contributes to improvement of toughness by refining the structure. However, even when Nb is excessively contained, an effect thereof is saturated and the weldability is inhibited. Therefore, when Nb is contained, the content of Nb is set to 0.100% or less. The content of Nb is preferably 0.050% or less. On the other hand, in order to stably obtain the effect of Nb, the content of Nb is preferably 0.003% or more. The content of Nb is more preferably 0.005% or more, and still more preferably 0.010% or more.

[Cu: 0 to 1.50%]

Cu is an effective element for increasing the hardness without deteriorating the toughness. However, excess Cu causes hot cracking during manufacturing. Therefore, when Cu is contained, the content of Cu is set to 1.50% or less. The content of Cu is preferably 1.00% or less, and more preferably 0.50% or less. On the other hand, in order to stably obtain an effect of Cu, the content of Cu is preferably 0.05% or more. The content of Cu is more preferably 0.10% or more.

[Ni: 0 to 2.00%]

Ni is effective for improving hardness and toughness. However, excess Ni also saturates an effect thereof, which raises the cost. Therefore, when Ni is contained, the content of Ni is set to 2.00% or less. The content of Ni is preferably 1.00% or less, and more preferably 0.80% or less or 0.50% or less. If necessary, the upper limit of the content of Ni may be set to 0.40%, 0.25%, or 0.10%. On the other hand, in order to stably obtain the effect of Ni, the content of Ni is preferably 0.05% or more. The content of Ni is more preferably set to 0.10% or more.

[Cr: 0 to 2.00%]

Cr is an element for improving hardenability. However, when the content of Cr exceeds 2.00%, toughness or weldability is impaired. Therefore, when Cr is contained, the content of Cr is set to 2.00% or less. The content of Cr is preferably 1.50% or less, and more preferably 1.00% or less. In order to further improve weldability, Cr may be 0.60% or less or 0.30% or less. On the other hand, in order to stably obtain the effect of Cr, the content of Cr is preferably 0.10% or more. The content of Cr is more preferably 0.30% or more.

[V: 0 to 0.20%]

V is an element that forms a carbide and a nitride to refine the structure and to improve hardenability. However, when the content of V exceeds 0.20%, toughness and weldability are impaired. Therefore, when V is contained, the content of V is set to 0.20% or less. The content of V is preferably 0.10% or less, and more preferably 0.05% or less. On the other hand, in order to stably obtain the effect of V, the content of V is preferably 0.003% or more. The content of V is more preferably 0.01% or more.

The abrasion-resistant steel of the disclosure may contain one or both of Ca and REM (Rare-Earth Metal) to control the morphology of an inclusion by forming an oxide or a sulfide. The inclusion of these elements is not indispensable, and the lower limit of these contents is all 0%.

[Ca: 0 to 0.0100%]

Excess Ca coarsens an inclusion, which inhibits the toughness. Therefore, when Ca is contained, the content of Ca is set to 0.0100% or less. The content of Ca is preferably 0.008% or less, and more preferably 0.0060% or less. On the other hand, in order to stably obtain the effect thereof, the content of Ca is preferably 0.0003% or more. The content of Ca is more preferably 0.0005% or more, and still more preferably 0.0010% or more.

[REM: 0 to 0.0100%]

Like Ca, excess REM coarsens an inclusion, which inhibits the toughness. Therefore, when REM is contained, the content of REM is set to 0.0100% or less. The content of REM is preferably 0.0080% or less, and more preferably 0.0060% or less. On the other hand, in order to stably obtain the effect thereof, the content of REM is preferably 0.0003% or more. The content of REM is more preferably 0.0005% or more, and still more preferably 0.0010% or more.

Here, REM means a rare earth element, which is a generic term for 17 kinds of elements consisting of Sc (scandium), Y (yttrium), La (lanthanum), Ce (cerium), Pr (praseodymium), Nd (neodymium), Pm (promethium), Sm (samarium), Eu (europium), Gd (gadolinium), Tb (terbium), Dy (dysprosium), Ho (holmium), Er (erbium), Tm (thulium), Yb (ytterbium), and Lu (lutetium).

The REM content refers to the total content of the above 17 kinds of elements.

The abrasion-resistant steel of the disclosure may contain Mg having the same effect as Ca and REM in place of Ca and REM or together with one of or both Ca and REM.

[Mg: 0 to 0.0100%]

Like Ca, excess Mg coarsens an inclusion, which inhibits the toughness. Therefore, when Mg is contained, the content of Mg is set to 0.0100% or less. The content of Mg is preferably 0.0050% or less, and more preferably 0.0030% or less. The content of Mg is not indispensable, and the lower limit of the content is 0%. On the other hand, in order to stably obtain the effect, the content of Mg is preferably 0.0003% or more. The content of Mg is more preferably 0.0005% or more, and still more preferably 0.0010% or more.

The abrasion-resistant steel of the disclosure may contain W in order to improve the abrasion resistance by improving the hardenability.

[W: 0 to 2.00%]

W is an element that improves hardenability. However, when the content of W exceeds 2.00%, toughness or weldability is impaired. Therefore, when W is contained, the content of W is set to 2.00% or less. The content of W is preferably 1.50% or less, and more preferably 1.00% or less. The inclusion of W is not indispensable, and the lower limit of the content is 0%. On the other hand, in order to stably obtain an effect of W, the content of W is preferably 0.10% or more. The content of W is more preferably 0.30% or more. W is an expensive element, and the upper limit of the content may be 0.30%, 0.10%, or 0.02%.

In the abrasion-resistant steel of the disclosure, the composition other than the above composition of steel are Fe and impurities.

Here, the impurities are composition that are mixed by a variety of factors in a manufacturing process, such as raw materials such as ores and scraps when a thick steel plate is industrially produced, and mean those acceptable within a range not adversely affecting the disclosure. However, in the disclosure, it is necessary to prescribe the upper limit for P, S, and N among the impurities as described above.

Examples of impurities include at least one kind of Sn, Sn, As, and Pb. Each content of Sn, Sn, As, and Pb is preferably from 0 to 0.10%. If necessary, the upper limit of the individual content of these elements may be 0.05% or 0.01%. The lower limit of the content of these elements is 0%.

[Ceq: 0.80% or Less]

The carbon equivalent (Ceq) is an index of hardenability, and it is preferably as large as possible in order to reduce the change in hardness in the thickness direction of the abrasion-resistant steel. However, the increase in Ceq means an increase in the content of an alloy. Therefore, Ceq should be limited as much as possible from the viewpoint of reducing the alloy cost. The higher the carbon equivalent, the higher the susceptibility to low temperature cracking after welding, and therefore, it is needed to increase a preheating temperature during welding of a steel. In the disclosure, in order to reduce the alloy cost and set the preheating temperature to 200° C. or less, Ceq is set to 0.80% or less. Ceq is preferably 0.75% or less, and more preferably 0.70% or less. On the other hand, Ceq is preferably 0.50% or more in order to effectively suppress the change in the hardness in the thickness direction of the abrasion-resistant steel. Ceq is more preferably set to 0.60% or more.

Here, Ceq is expressed by the following (Formula 1).

$$Ceq = C + Mn/6 + (Cu+Ni)/15 + (Cr+Mo+V)/5 \quad \text{(Formula 1)}$$

where C, Mn, Cu, Ni, Cr, Mo, and V are the content (mass %) of each element, and when the element is not contained, the value is set to 0. According to the disclosure, it is possible to suppress the increase in the content of alloy by improving steel hardenability or the like by controlling the content of each element contained in a steel within the range individually explained above and limiting the relationship of C, Mn, Cu, Ni, Cr, Mo, and V within the above range.

Next, the metal structure of the abrasion-resistant steel of the disclosure will be described.

In order to ensure abrasion resistance, it is preferable that the metal structure is hard martensite. In particular, from the viewpoint of prolonging the life span, it is important to prevent the hardness from decreasing in the thickness direction from the surface layer. In relation to this, in the abrasion-resistant steel of the disclosure, the area ratio of martensite in a central portion in the thickness direction is high, and therefore, it is possible to secure abrasion resistance for a long time. The metal structure (the balance) other than the martensite is not particularly limited, and one kind, or two or more kinds of ferrite, pearlite and bainite may be used.

[Area Ratio of Martensite in Central Portion in Thickness Direction: 70% or More]

Specifically, in the abrasion-resistant steel of the disclosure, the area ratio of martensite in a central portion in the thickness direction is set to 70% or more. The area ratio is preferably as high as 80% or more or 90% or more, and more preferably almost 100%. Therefore, according to the abrasion-resistant steel of the disclosure, the abrasion resistance can be secured over a long period of time.

Here, "a central portion in the thickness direction" means a range of 0.5 mm (or 1 mm thick) from the center in the thickness direction of the abrasion-resistant steel.

Specifically, "a central portion in the thickness direction" refers to a range of 0.5 mm from the center in the thickness direction when the abrasion-resistant steel is a steel plate, in the plate thickness direction in the case of a steel tube, or in the flange thickness direction in the case of a section steel.

The area ratio of martensite is the area ratio when a cross section cut along the thickness direction is observed. In the disclosure, martensite is a lath structure. The lath structure is an extremely fine structure (elongated structure with a thickness of about from 0.1 to 0.2 μm), and as observed with an optical microscope, it is observed as a structure showing parallel black-and-white contrast as shown in FIG. 3.

Specifically, the area ratio of martensite is measured by the following method.

A sample cut along the thickness direction is obtained from an abrasion-resistant steel to be measured. Polishing and nital etching are performed on a cut surface of the sample. Next, on the cut surface of the sample, a region located in a central portion in the thickness direction is observed with an optical microscope (it is preferable to set an observation field of view to an area of 200 μm×200 μm or more). Next, the lath structure is determined in the observation field of view. Then, the area ratio of the lath structure determined with respect to the observation field of view is obtained as the area ratio of martensite.

However, even in cases in which the area ratio of martensite (lath martensite structure) is 70% or more, when the Vickers hardness at a central portion in the thickness direction (HV10 of JIS Z2244 (2009)) is less than 70% of the hardness of martensite obtained from the content of C according to the following Formula 2, observation with an electron microscope is carried out. As a result, the area where cementite has been observed is determined as bainite and is excluded, and the area ratio of martensite is obtained. In other words, when the Vickers hardness HV10 in a central portion in the thickness direction is HM×0.70 or more, it is only necessary to determine the area ratio of martensite by an optical microscope and observation by an electron microscope is unnecessary.

Vickers hardness of martensite (Vickers hardness when 100% of metal structure is martensite) HM can be obtained by the following Formula. Here, C is the content of C (unit: mass %).

$$HM = 884C\ (1-0.3C^2) + 294 \quad \text{(Formula 2)}$$

[Mass Fraction of $Mo_2FeB_2$: 0.0010 to 0.1000%]

In the present disclosure, precipitation of $Mo_2FeB_2$ is important for effectively utilizing the hardenability of B. Therefore, the mass fraction of $Mo_2FeB_2$ is set to 0.0010% or more. The mass fraction of $Mo_2FeB_2$ is preferably 0.0015% or more, more preferably 0.0020% or more, and particularly preferably 0.0040% or more. However, also when $Mo_2FeB_2$ is excessively precipitated, the effect of B is impaired, and therefore, the mass fraction of $Mo_2FeB_2$ is set to 0.1000% or less.

[Mass Fraction of $Fe_{23}(C, B)_6$: 0.0020% or Less]

In contrast, $Fe_{23}(C,B)_6$ is a precipitate which impairs an effect of B. Therefore, it is preferable to suppress precipitation of $Fe_{23}(C,B)_6$. Therefore, the mass fraction of $Fe_{23}(C,B)_6$ is preferably 0.0030% or less. The mass fraction of $Fe_{23}(C,B)_6$ is preferably 0.0020% or less, more preferably 0.0015% or less, and particularly preferably 0.0010% or less. The lower limit of the mass fraction of $Fe_{23}(C,B)_6$ is not specified, and may be 0%.

Here, the content of precipitation of $Mo_2FeB_2$ and $Fe_{23}(C,B)_6$ is determined by an extraction residue analysis method. In the extraction residue analysis method, a steel is dissolved by electrolysis in a non-aqueous solvent (acetylacetone-methanol solution or the like) to dissolve a parent phase, and the residue (a precipitate and an inclusion) is extracted with a filter having a pore size (diameter) of 0.2 μm and separated. The mass fraction of compounds contained in the residue after separation can be determined by identification by X-ray diffraction method and measuring the content of each element by chemical analysis.

Next, a method of manufacturing the abrasion-resistant steel of the disclosure will be described.

The abrasion-resistant steel of the disclosure is manufactured by hot working a steel piece into a desired shape, cooling to room temperature, reheating, and quenching the piece.

In the manufacturing of the abrasion-resistant steel of the disclosure, the reheating temperature of quenching is important to generate $Mo_2FeB_2$. When the temperature exceeds 1,100° C., $Mo_2FeB_2$ solid-dissolves, the reheating temperature is set to 1,100° C. or lower. The reheating temperature is preferably 1,000° C. or less. The reheating temperature is set to $A_{c3}$ or higher. Although $A_{c3}$ may be used from known calculations or measured values, $A_{c3}$ may be calculated from the content of each element, for example, using the following Formula. Here, C, Si, Mn, Ni, and Cr are the content (unit: mass %) of each element.

$$Ac3(°\ C.)=854-180C+44Si-14Mn-17.8Ni-1.7Cr \quad \text{(Formula 3)}$$

When the reheating temperature is lower than 650° C., since $Fe_{23}(C,B)_6$ is precipitated, the reheating temperature is set to 650° C. or higher. The reheating temperature is preferably 700° C. or more, and more preferably 800° C. or more.

A hot working to form a desired shape and a previous step may be a known method. For example, a molten steel may be manufactured by melting a molten steel by a known method such as a converter, an electric furnace, or the like, and then subjecting the molten steel to a steel material such as a slab or a billet by a known method such as a continuous casting method or a casting method and subjecting the steel to hot working. Processing such as ladle refining and vacuum degassing may be applied to the molten steel. A steel material after casting or ingot may be hot worked as it is. A known method such as hot rolling or hot forging can be employed for hot working. A steel plate may be welded to form a steel pipe or a shape steel.

EXAMPLES

A steel piece obtained by melting a steel having the composition shown in Table 1 was hot rolled to obtain a steel plate having a thickness shown in Table 2 and the steel plate was heated to a reheating temperature shown in Table 2 and quenched. Then, a sample including a central portion in the thickness direction in the plate thickness direction cross section of an obtained steel plate (or in a range of 0.5 mm from the center in the plate thickness direction of the steel plate) was collected. Then, for the collected samples, the martensite area ratio was measured with an optical microscope, and precipitates ($Mo_2FeB_2$, $Fe_{23}(C,B)_6$) were analyzed by an extraction residue method. Samples containing the surface of a steel plate or a central portion in the plate thickness were collected, the Brinell hardness on the surface of the steel plate was measured, and the Vickers hardnesses of the surface layer (from 0.5 to 1 mm deep from the steel plate surface) and the central portion in the thickness direction (plate thickness/2) were measured.

Here, the Brinell hardness ($HBW^{10}/_{3000}$) on the surface of the steel plate was measured in accordance with JIS Z 2243 (2008). In the measurement conditions ($HBW^{10}/_{3000}$), the load P=3000 kgf, and the diameter D of sphere D=10 mm.

For Vickers hardness, HV10 was measured in accordance with JIS Z 2244 (2009). Specific measurement conditions are Vickers square pyramid diamond indenter with an indenter=facing angle 136°, indentation load=10 gf, and pushing time=20 s.

The results are shown in Table 2.

TABLE 1

| Steel | Chemical composition (mass %) Balance = Fe + impurities | | | | | | | | | | |
|---|---|---|---|---|---|---|---|---|---|---|---|
| No. | C | Si | Mn | P | S | Al | Mo | B | N | Nb | Ti |
| 1 | 0.13 | 0.15 | 0.80 | 0.012 | 0.003 | 0.040 | 1.30 | 0.0023 | 0.0035 | 0.005 | 0.010 |
| 2 | 0.34 | 0.45 | 0.73 | 0.009 | 0.004 | 0.050 | 0.80 | 0.0015 | 0.0028 | 0.003 | 0.015 |
| 3 | 0.18 | 0.25 | 1.30 | 0.012 | 0.003 | 0.035 | 0.70 | 0.0018 | 0.0030 | | 0.010 |
| 4 | 0.23 | 0.30 | 1.50 | 0.010 | 0.005 | 0.070 | 0.73 | 0.0015 | 0.0035 | 0.003 | 0.013 |
| 5 | 0.13 | 0.05 | 0.50 | 0.012 | 0.003 | 0.200 | 2.10 | 0.0016 | 0.0040 | | |
| 6 | 0.16 | 0.05 | 1.50 | 0.012 | 0.003 | 0.100 | 0.80 | 0.0016 | 0.0040 | | |
| 7 | 0.19 | 0.20 | 1.00 | 0.010 | 0.003 | 0.070 | 0.60 | 0.0025 | 0.0028 | | |
| 8 | 0.21 | 0.50 | 1.40 | 0.012 | 0.005 | 0.100 | 0.75 | 0.0021 | 0.0035 | 0.030 | |
| 9 | 0.27 | 0.25 | 0.83 | 0.006 | 0.001 | 0.060 | 0.85 | 0.0015 | 0.0045 | 0.002 | |
| 10 | 0.36 | 0.41 | 0.68 | 0.008 | 0.004 | 0.050 | 0.90 | 0.0040 | 0.0033 | | |
| 11 | 0.27 | 0.40 | 0.95 | 0.007 | 0.003 | 0.068 | 0.85 | 0.0015 | 0.0025 | | |
| 12 | 0.17 | 0.20 | 0.80 | 0.012 | 0.005 | 0.035 | 0.65 | 0.0018 | 0.0030 | 0.003 | 0.011 |
| 13 | 0.22 | 0.35 | 1.20 | 0.010 | 0.007 | 0.070 | 0.68 | 0.0017 | 0.0035 | | 0.012 |
| 14 | 0.13 | 0.15 | 0.80 | 0.012 | 0.003 | 0.008 | 1.30 | 0.0023 | 0.0035 | 0.005 | 0.010 |
| 15 | 0.18 | 0.25 | 1.30 | 0.012 | 0.003 | 0.035 | 0.50 | 0.0020 | 0.0035 | | 0.010 |
| 16 | 0.13 | 0.05 | 0.50 | 0.012 | 0.003 | 0.200 | 2.10 | 0.0060 | 0.0040 | 0.005 | |
| 17 | 0.09 | 0.40 | 0.70 | 0.009 | 0.002 | 0.070 | 0.70 | 0.0018 | 0.0040 | | |
| 18 | 0.26 | 0.20 | 0.76 | 0.006 | 0.001 | 0.080 | 0.65 | 0.0015 | 0.0041 | | 0.002 |
| 19 | 0.22 | 0.30 | 1.20 | 0.006 | 0.003 | 0.050 | 0.75 | 0.0021 | 0.0035 | 0.010 | 0.013 |

| Steel | Chemical composition (mass %) Balance = Fe + impurities | | | | | | | | [Mo] × | |
|---|---|---|---|---|---|---|---|---|---|---|
| No. | Cu | Ni | Cr | V | Ca | REM | Mg | W | [B] | C eq |
| 1 | 0.10 | 0.10 | 0.60 | 0.02 | 0.0050 | | | | 0.0030 | 0.66 |
| 2 | 0.15 | 0.15 | 0.50 | 0.01 | | 0.0050 | | | 0.0012 | 0.74 |
| 3 | | | 0.65 | | | | | | 0.0013 | 0.67 |
| 4 | | | | 0.01 | | | | | 0.0011 | 0.63 |
| 5 | | | | | | 0.0050 | | | 0.0034 | 0.63 |
| 6 | | | | | 0.0050 | | | | 0.0013 | 0.57 |
| 7 | | | | | | | | | 0.0015 | 0.48 |
| 8 | | 0.40 | 0.65 | | | | | | 0.0016 | 0.75 |
| 9 | 0.21 | 0.50 | 0.50 | | 0.0050 | | 0.0020 | | 0.0013 | 0.73 |
| 10 | | | | | | | | | 0.0036 | 0.65 |
| 11 | | | | | | | | | 0.0013 | 0.60 |
| 12 | | | 0.65 | | | | | 1.20 | 0.0012 | 0.56 |
| 13 | | | | 0.01 | | | | 0.20 | 0.0012 | 0.56 |
| 14 | 0.10 | 0.10 | 0.60 | 0.02 | 0.0050 | | | | 0.0030 | 0.66 |
| 15 | | | 0.90 | | | | | | 0.0010 | 0.68 |

TABLE 1-continued

| | | | | | | | |
|---|---|---|---|---|---|---|---|
| 16 | | | | 0.10 | 0.0050 | 0.0126 | 0.65 |
| 17 | | | | 0.10 | 0.0050 | 0.0013 | 0.37 |
| 18 | 0.10 | 0.10 | | | | 0.0010 | 0.53 |
| 19 | | 0.40 | 0.65 | | | 0.0016 | 0.73 |

The blank column means that alloy elements are not intentionally contained.

Underline means outside the scope of the present disclosure.

TABLE 2

| Steel No. | Plate thickness mm | Manufacture conditions Reheating temperature (quenching temperature at RQ) ° C. | Metal structure Martensite structure ratio % | Extraction residue method $Mo_2FeB_2$ mass fraction % | Extraction residue method $Fe_{23}(C,B)_6$ mass fraction % | Hardness Brinell hardness Surface HB | Hardness Vickers hardness (A)Surface layer Hv |
|---|---|---|---|---|---|---|---|
| 1 | 80 | 880 | 97 | 0.0060 | 0.0000 | 364 | 389 |
| 2 | 80 | 890 | 89 | 0.0018 | 0.0025 | 527 | 565 |
| 3 | 120 | 910 | 92 | 0.0030 | 0.0010 | 404 | 432 |
| 4 | 90 | 930 | 88 | 0.0020 | 0.0027 | 443 | 474 |
| 5 | 120 | 920 | 97 | 0.0077 | 0.0000 | 364 | 389 |
| 6 | 60 | 890 | 95 | 0.0029 | 0.0027 | 388 | 415 |
| 7 | 65 | 840 | 88 | 0.0020 | 0.0005 | 412 | 440 |
| 8 | 120 | 930 | 95 | 0.0033 | 0.0015 | 423 | 452 |
| 9 | 120 | 1050 | 93 | 0.0029 | 0.0005 | 469 | 502 |
| 10 | 100 | 950 | 92 | 0.0083 | 0.0000 | 537 | 575 |
| 11 | 70 | 910 | 88 | 0.0015 | 0.0022 | 469 | 502 |
| 12 | 110 | 910 | 91 | 0.0028 | 0.0010 | 396 | 423 |
| 13 | 70 | 930 | 93 | 0.0021 | 0.0027 | 435 | 466 |
| 14 | 75 | 880 | 95 | 0.0054 | 0.0002 | 364 | 389 |
| 15 | 120 | 910 | 52 | 0.0000 | 0.0030 | 404 | 432 |
| 16 | 120 | 850 | 36 | 0.1300 | 0.0000 | 364 | 389 |
| 17 | 75 | 980 | 37 | 0.0060 | 0.0000 | 333 | 355 |
| 18 | 65 | 880 | 34 | 0.0005 | 0.0030 | 466 | 499 |
| 19 | 120 | 1150 | 62 | 0.0000 | 0.0040 | 431 | 461 |

| Steel No. | Hardness Vickers hardness (B)Central portion Hv | ΔHv ((A) − (B)) Surface layer − center | (B)/(A) Surface layer/center | HM Hv | HM × 0.70 Hv | (B)/HM | Notes |
|---|---|---|---|---|---|---|---|
| 1 | 380 | 9 | 0.98 | 408 | 286 | 0.93 | Present disclosure |
| 2 | 470 | 95 | 0.83 | 584 | 409 | 0.80 | Present disclosure |
| 3 | 375 | 57 | 0.87 | 452 | 316 | 0.83 | Present disclosure |
| 4 | 375 | 99 | 0.79 | 494 | 346 | 0.76 | Present disclosure |
| 5 | 387 | 2 | 0.99 | 408 | 286 | 0.95 | Present disclosure |
| 6 | 387 | 28 | 0.93 | 434 | 304 | 0.89 | Present disclosure |
| 7 | 350 | 91 | 0.79 | 460 | 322 | 0.76 | Present disclosure |
| 8 | 431 | 22 | 0.95 | 477 | 334 | 0.90 | Present disclosure |
| 9 | 456 | 46 | 0.91 | 527 | 369 | 0.86 | Present disclosure |
| 10 | 511 | 65 | 0.89 | 600 | 420 | 0.85 | Present disclosure |
| 11 | 410 | 92 | 0.82 | 527 | 369 | 0.78 | Present disclosure |
| 12 | 359 | 65 | 0.85 | 443 | 310 | 0.81 | Present disclosure |
| 13 | 420 | 46 | 0.90 | 486 | 340 | 0.86 | Present disclosure |
| 14 | 366 | 23 | 0.94 | 408 | 286 | 0.90 | Present disclosure |

TABLE 2-continued

| | | | | | | | |
|---|---|---|---|---|---|---|---|
| 15 | 302 | 130 | 0.70 | 452 | 316 | 0.67 | Comparative Example |
| 16 | 250 | 139 | 0.64 | 408 | 286 | 0.61 | Comparative Example |
| 17 | 229 | 126 | 0.64 | 373 | 261 | 0.61 | Comparative Example |
| 18 | 317 | 182 | 0.63 | 519 | 363 | 0.61 | Comparative Example |
| 19 | 343 | 118 | 0.74 | 486 | 340 | 0.71 | Comparative Example |

Underline means outside the scope of the present disclosure.

As shown in Table 2, steels No. 1 to 14 are the abrasion-resistant steel of the disclosure, the martensite structure ratio in a central portion in the thickness is as high as 70% or more, the difference between the hardness of the surface layer and the central portion in the thickness of each steel is less than 100 Hv, which is relatively small. On the other hand, steels No. 15 to 19 shows that the difference between the hardness of the surface layer and the hardness of the central portion in the thickness greatly exceeds 100 Hv, which is very large compared with steels No. 1 to 14. In steel No. 15, the content of Mo is small and the value of [Mo]×[B] is small, steel No. 16 has a large content of B, steel No. 17 has a small content of C, and since steel No. 18 has a small value of [Mo]×[B], the hardenability is deteriorated in either case, and the hardness in the central portion in the thickness is lowered. In steel No. 15 and steel no. 18, since the content of $Mo_2FeB_2$ is small, $Fe_{23}(C,B)_6$ is formed, the hardenability is deteriorated, and the hardness in the central portion in the thickness decreases in each case. In steel No. 19, the reheating temperature of quenching is high, $Mo_2FeB_2$ disappears, and $Fe_{23}(C,B)_6$ is formed, and therefore, the hardenability decreases and the hardness at the central portion of the thickness decreases.

INDUSTRIAL APPLICABILITY

The abrasion-resistant steel of the disclosure can be used, for example, in industrial machinery such as a cutting edge of a processing machine for industrial waste. The abrasion-resistant steel of the disclosure can secure the hardenability stably even when the cooling rate changes, and is particularly suitable for a member requiring a thick abrasion-resistant steel having a plate thickness exceeding 50 mm. The abrasion-resistant steel of the disclosure can be used for steel plates, section steels, steel pipes, and the like.

The content of the disclosure by Japanese Patent Application No. 2016-180889 is herein entirely incorporated by reference.

All publications, patent applications, and technical standards mentioned in this specification are herein incorporated by reference to the same extent as if each individual publication, patent application, and technical standard were specifically and individually indicated to be incorporated by reference.

The invention claimed is:

1. An abrasion-resistant steel, comprising, by mass %:
C: 0.10 to 0.40%,
Si: 0.05 to 0.50%,
Mn: 0.50 to 1.50%,
B: 0.0015 to 0.0050%,
Mo: 0.60 to 2.50%,
Al: 0 to 0.300%,
S: 0.010% or less,
P: 0.015% or less,
N: 0.0080% or less,
Ti: 0 to 0.100%,
Nb: 0 to 0.100%,
Cu: 0 to 1.50%,
Ni: 0 to 2.00%,
Cr: 0 to 2.00%,
V: 0 to 0.20%,
Ca: 0 to 0.0100%,
REM: 0 to 0.0100%,
Mg: 0 to 0.0100%,
W: 0 to 2.00%, and
a balance: Fe and impurities, wherein:
contents (mass %) of Mo and B satisfy Mo×B>0.0010,
a mass fraction of $Mo_2FeB_2$ is from 0.0010 to 0.1000%,
an area ratio of martensite in a central portion in a thickness direction is 70% or more,
Ceq obtained by the following (Formula 1) is 0.80% or less, and
a plate thickness exceeds 50 mm;

$$Ceq = C + Mn/6 + (Cu+Ni)/15 + (Cr+Mo+V)/5 \quad \text{(Formula 1)},$$

wherein, in (Formula 1), C, Mn, Cu, Ni, Cr, Mo, and V are contents (mass %) of each element.

2. The abrasion-resistant steel according to claim 1, wherein a mass fraction of $Fe_{23}(C, B)_6$ is 0.0020% or less.

3. The abrasion-resistant steel according to claim 1 or 2, wherein the contents (mass %) of Mo and B satisfy Mo×B≥0.0015.

4. The abrasion-resistant steel according to claim 1 or 2, wherein the contents (mass %) of Mo and B satisfy Mo×B≥0.0020.

5. The abrasion-resistant steel according to claim 1 or 2, wherein a content (mass %) of Mo satisfies from 0.70 to 2.50%.

* * * * *